US010329076B2

(12) United States Patent
Kitora et al.

(10) Patent No.: US 10,329,076 B2
(45) Date of Patent: Jun. 25, 2019

(54) DOUBLE-WALLED CONTAINER

(71) Applicants: Shuichi Kitora, Tokyo (JP); Tomoaki Kurihara, Tokyo (JP); Keisuke Miyairi, Tokyo (JP)

(72) Inventors: Shuichi Kitora, Tokyo (JP); Tomoaki Kurihara, Tokyo (JP); Keisuke Miyairi, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 15/543,115

(22) PCT Filed: Jan. 20, 2016

(86) PCT No.: PCT/JP2016/000275
§ 371 (c)(1),
(2) Date: Jul. 12, 2017

(87) PCT Pub. No.: WO2016/121343
PCT Pub. Date: Aug. 4, 2016

(65) Prior Publication Data

US 2018/0016085 A1 Jan. 18, 2018

(30) Foreign Application Priority Data

Jan. 30, 2015 (JP) ..... 2015-017520

(51) Int. Cl.
*B65D 83/00* (2006.01)
*B65D 1/02* (2006.01)
(Continued)

(52) U.S. Cl.
CPC ..... *B65D 83/0055* (2013.01); *B65D 1/02* (2013.01); *B65D 1/0276* (2013.01); *B65D 1/06* (2013.01); *B65D 1/42* (2013.01)

(58) Field of Classification Search
CPC ..... B65D 83/0061; B65D 83/0055; B65D 79/005; B65D 25/14; B65D 11/20;
(Continued)

(56) References Cited

U.S. PATENT DOCUMENTS 4,469,250 A * 9/1984 Evezich ..... B65D 83/0055 222/83.5
5,160,072 A * 11/1992 Nye ..... B65D 83/0061 222/463
(Continued)

FOREIGN PATENT DOCUMENTS

JP H05-310265 A 11/1993
JP H07-508959 A 10/1995
(Continued)

OTHER PUBLICATIONS

Aug. 1, 2017 International Preliminary Report on Patentability issued in International Patent Application No. PCT/JP2016/000275.
(Continued)

*Primary Examiner* — Robert J Hicks
(74) *Attorney, Agent, or Firm* — Oliff PLC

(57) ABSTRACT

A double-walled container including: an outer layer body; an inner layer body, which is provided in a pinched-off portion and which passes through the outer layer body. The pinched-off portion is formed in a bottom due to pinch-off using a splittable mold in blow molding. The bottom is provided, on an inner side in a radial direction of an outer edge portion thereof, which serves as a ground-contacting surface, with a substantially cross-shaped recess, which is concave toward a mouth. The recess is configured by a first-direction recess portion, which extends along an extending direction of the slit, and a second-direction recess portion, which intersects with the first-direction recess portion. The slit is provided in
(Continued)

a region in which the first-direction recess portion and the second-direction recess portion intersect with each other.

8 Claims, 4 Drawing Sheets

(51) Int. Cl.
*B65D 1/42* (2006.01)
*B65D 1/06* (2006.01)

(58) Field of Classification Search
CPC .... B65D 1/0276; B65D 1/0261; B65D 1/023; B65D 1/0223; B65D 1/0215; B65D 1/0207; B65D 1/44; B65D 1/42; B65D 1/40
USPC ..... 215/12.1, 44, 43, 373, 372, 371, 370, 215/381; 220/62.22, 62.21, 62.12, 62.11, 220/609, 608, 604
See application file for complete search history.

(56) References Cited

U.S. PATENT DOCUMENTS

| | | | | |
|---|---|---|---|---|
| 5,269,437 | A | 12/1993 | Gygax | |
| 5,419,465 | A * | 5/1995 | Schroeder | B65D 83/0055 222/386.5 |
| 5,711,454 | A | 1/1998 | Kobayashi et al. | |
| 5,921,438 | A | 7/1999 | Kobayashi et al. | |
| 6,632,493 | B1 * | 10/2003 | Hildebrand, IV | B65D 1/0215 222/206 |
| 2009/0008356 | A1 * | 1/2009 | Gadzic | B65D 47/265 215/310 |
| 2015/0314907 | A1 * | 11/2015 | Kira | B65D 1/0223 215/383 |
| 2016/0052661 | A1 * | 2/2016 | Furusawa | B65D 1/0215 215/12.2 |
| 2017/0121049 | A1 * | 5/2017 | Bouquin | B65D 1/0284 |

FOREIGN PATENT DOCUMENTS

| | | | |
|---|---|---|---|
| JP | 2008-207860 | A | 9/2008 |
| JP | 2011-073770 | A | 4/2011 |
| JP | 2011-230817 | A | 11/2011 |
| JP | 2014-193741 | A | 10/2014 |
| JP | 2014-196121 | A | 10/2014 |
| JP | 2014-231392 | A | 12/2014 |
| WO | 2014068876 | A1 | 5/2014 |

OTHER PUBLICATIONS

Apr. 12, 2016 International Search Report issued in International Patent Application No. PCT/JP2016/000275.
May 28, 2018 Office Action issued in Chinese Patent Application No. 201680006644.9.
Aug. 31, 2018 Search Report issued in European Patent Application No. 16742948.9.
Oct. 2, 2018 Office Action issued in Japanese Patent Application No. 2015-017520.
Oct. 24, 2018 Office Action issued in Chinese Patent Application No. 201680006644.9.
Mar. 12, 2019 Office Action issued in Chinese Patent Application No. 201680006644.9.
May 7, 2019 Office Action issued in Japanese Patent Applicaiton No. 2015-017520.

* cited by examiner

D-D section

DOUBLE-WALLED CONTAINER

TECHNICAL FIELD

The present disclosure relates to a double-walled container including an outer layer body that constitutes an outer shell of the container and an inner layer body that is accommodated inside the outer layer body and that is deformable to undergo volume reduction. In the double-walled container, only the inner layer body undergoes volume reduction in response to dispensing of a content medium.

BACKGROUND

As an example of a container to contain cosmetics such as face lotion, shampoo, rinse, liquid soap, food seasoning, or the like, a double-walled container (which is also called delamination container) is known. Such double-walled container includes the outer layer body that constitutes the outer shell of the container and the inner layer body that is accommodated inside the outer layer body and that is deformable to undergo volume reduction. Furthermore, the outer layer body is provided with an ambient air introduction hole that communicates between the outer layer body and the inner layer body, and only the inner layer body undergoes volume reduction in response to dispensing of the content medium.

The content medium may be dispensed by various methods, such as using a pump fitted to a mouth of the outer layer body, mainly utilizing squeezing of a trunk of the outer layer body, and mainly utilizing the own weight of the content medium (refer, for example, to Patent Literature 1). In a container using the pump, the configuration is complicated, and moreover, cost increase is inevitable. In a container utilizing squeezing of the outer layer body, the configuration is relatively simplified. However, to cause only the inner layer body to undergo volume reduction, it is necessary to provide an ambient air introduction valve that is configured to close the ambient air introduction hole when the outer layer body is pressed and to open the ambient air introduction hole when the pressure is released. On the other hand, a container utilizing the own weight of the content medium has a simplified configuration and besides, it does not need the ambient air introduction valve. Accordingly, such a container is excellent in cost reduction.

In particular, when such a container utilizing the own weight of the content medium is formed by blow molding a parison, a pinched-off portion formed due to pinch-off using a splittable mold in the blow molding may be used directly as the ambient air introduction hole. The parison has been formed by laminating the outer layer body made of a synthetic resin and the inner layer body made of another synthetic resin having low compatibility with the outer layer body. That is to say, by splitting a bottom wall of the outer layer body at the pinched-off portion, the inner layer body is separated from the inner layer body. Thus, the slit-shaped ambient air introduction hole is provided in the pinched-off portion.

CITATION LIST

Patent Literature

PTL 1: JP 2008207860A

SUMMARY

Technical Problem

Meanwhile, the inner layer body of the double-walled container is furnished with various contrivances so that the entire inner layer body undergoes uniform volume reduction. Nevertheless, due to variation in thickness of the inner layer body itself, some portions thereof may collapse easily and preferentially. Consequently, as more of the content medium is dispensed, some portions of the inner surface of the inner layer body might contact each other, thereby leaving only a narrow passage for the content medium. Although, even in this case, a container using the pump or including the ambient air introduction valve may dispense the content medium until the container is empty, the complicated configuration and cost increase are inevitable as described above. On the other hand, in a blow molded double-walled container that uses the pinched-off portion as the ambient air introduction hole and that is configured to dispense the content medium mainly by its own weight, the following problem arises. That is to say, even when the outer layer body is squeezed, air that is present between the outer layer body and the inner layer body leaks from the ambient air introduction hole, and the inner layer body fails to undergo sufficient volume reduction. This makes it difficult to dispense the content medium. Accordingly, there has been a need for a novel double-walled container in which the above point is improved.

The present disclosure is to solve the above existing problem. The present disclosure is to propose a double-walled container that permits the content medium to be dispensed by its own weight and that also permits smooth dispensing by utilizing squeezing of the outer layer body by reducing the amount of air leaking from the ambient air introduction hole provided in the pinched-off portion when the outer layer body is squeezed

Solution to Problem

One of aspects of the present disclosure to solve the above problem resides in a double-walled container with a bottle shape including a mouth, a trunk, and a bottom. The double-walled container includes: an outer layer body that constitutes an outer shell of the double-walled container; an inner layer body that is accommodated inside the outer layer body and configured to be deformed to undergo volume reduction; and a straight slit that is provided in a pinched-off portion and that passes through the outer layer body, the pinched-off portion being formed in the bottom due to pinch-off using a splittable mold in blow molding. The bottom is provided, on an inner side in a radial direction of an outer edge portion thereof serving as a ground-contacting surface, with a substantially cross-shaped recess that is concave toward the mouth. The recess is configured by a first-direction recess portion that extends along an extending direction of the slit and a second-direction recess portion that intersects with the first-direction recess portion, and the slit is provided in a region in which the first-direction recess portion and the second-direction recess portion intersect with each other.

In a preferred embodiment of the double-walled container according to the present disclosure, the first-direction recess portion and the second-direction recess portion each have a substantially elliptical shape in a plan view thereof, and each of the first-direction recess portion and the second-direction recess portion has a depth from the outer edge portion serving as the ground-contacting surface that increases gradually from an outer side to an inner side in the radial direction and that is maximum in the region in which the first-direction recess portion and the second-direction recess portion intersect with each other.

In another preferred embodiment of the double-walled container according to the present disclosure, the bottom is provided, on outer sides of both end portions of the slit provided in the pinched-off portion, with a pair of reinforcing ribs that extends along an extension line of the slit.

In yet another preferred embodiment of the double-walled container according to the present disclosure, each of the pair of reinforcing ribs is formed with at least one bitten portion in which the reinforcing rib is bitten from one lateral surface toward another lateral surface thereof.

In yet another preferred embodiment of the double-walled container according to the present disclosure, the at least one bitten portion formed in each of the pair of reinforcing ribs comprises a pair of bitten portions configured to have opposite bite directions to each other.

Advantageous Effect

The present disclosure provides a double-walled container that permits the content medium to be dispensed by its own weight and that also permits smooth dispensing by utilizing squeezing of the outer layer body by reducing the amount of air leaking from the ambient air introduction hole provided in the pinched-off portion when the outer layer body is squeezed.

DETAILED DESCRIPTION

Figure 1:
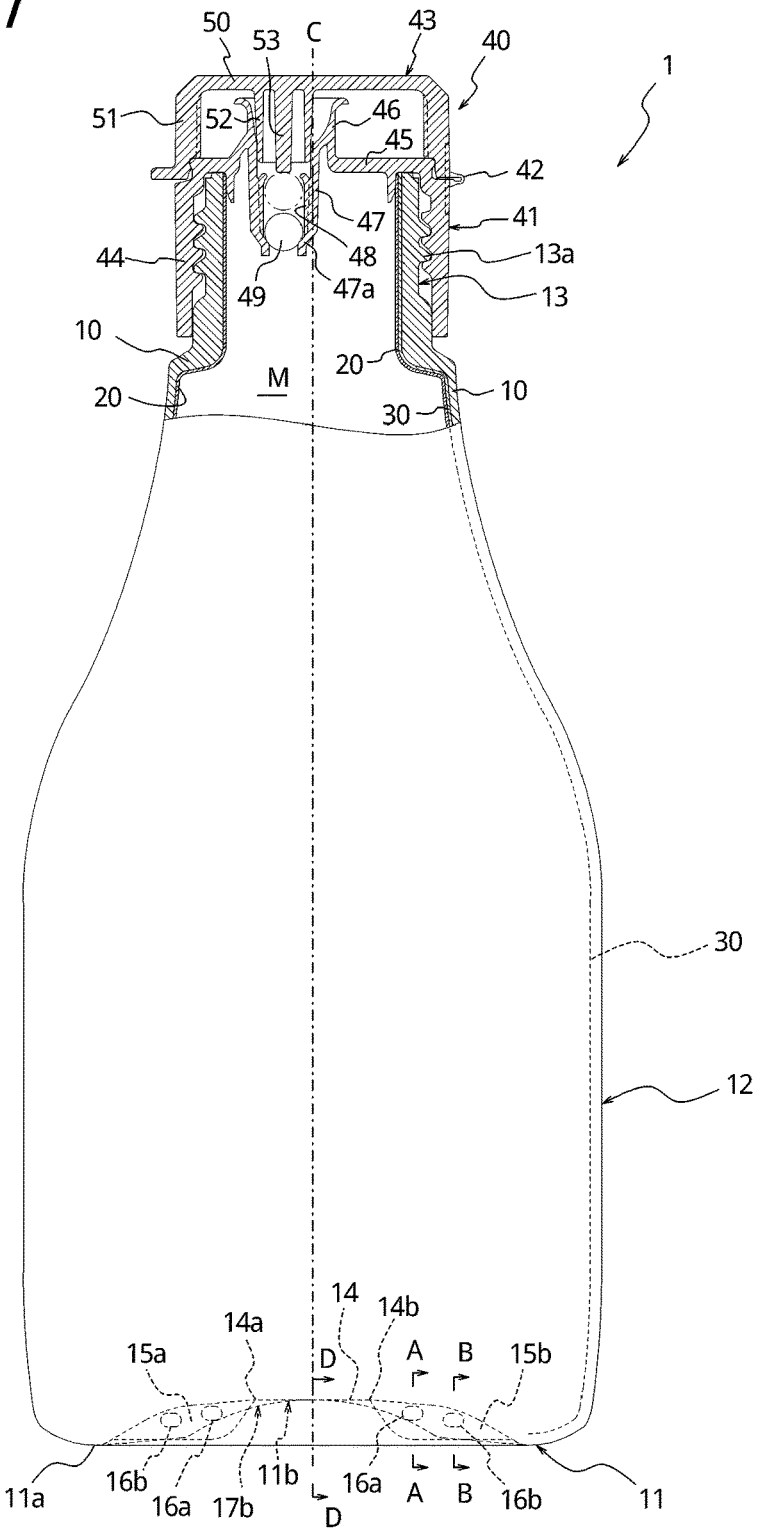
FIG. 1 is a front view, partially in a section, illustrating a double-walled container according to one of embodiments of the present disclosure.

The present disclosure will be described in more detail below by illustration with reference to the drawings. FIG. 1 is a front view, partially in a section, illustrating a double-walled container according to one of embodiments of the present disclosure.

A double-walled container 1 includes an outer layer body 10, which constitutes an outer shell of the container, and an inner layer body 20, which is accommodated inside the outer layer body 10 and which is deformable to undergo volume reduction. Between the outer layer body 10 and the inner layer body 20, there is provided an adhesive strip 30, which bonds the outer layer body 10 and the inner layer body 20.

The double-walled container 1 of the present embodiment has a laminated structure including the outer layer body 10, which is made of a synthetic resin, the inner layer body 20, which is made of another synthetic resin having low compatibility with the outer layer body 10, and the adhesive strip 30, which is a strip-shaped adhesive layer made of yet another synthetic resin having adhesion to the outer layer body 10 and the inner layer body 20. The double-walled container 1 is obtained by blow-molding a parison which has been prepared by laminating these synthetic resins. In this regard, in the double-walled container 1 of the present embodiment, the outer layer body 10 has a double-layered structure with low-density polyethylene (LDPE) located on the outer side and polypropylene (PP) resin located on the inner side. The inner layer body 20 has a double-layered structure with ethylene vinyl alcohol copolymer (EVOH) resin located on the outer side and modified polyolefin resin (e.g., Admer®: Admer, manufactured by Mitsui Chemicals, Inc., is a registered trademark in Japan, other countries, or both) located on the inner side. The adhesive strip 30 is formed by modified polyolefin resin (e.g., Admer®). Additionally, although in the present embodiment the outer layer of the outer layer body 10 is formed by low-density polyethylene (LDPE) to impart squeeze properties, the outer layer of the outer layer body 10 may be formed by polypropylene (PP) resin, medium-density polyethylene (MDPE) resin, or high-density polyethylene (HDPE) resin. Furthermore, the polypropylene (PP) resin layer constituting the outer layer body 10 of the present embodiment is provided to improve separability of the inner layer body 20 and is not necessarily indispensable. Moreover, the above layered structures are merely illustrative. As long as the inner layer body 20 is separable from the outer layer body 10, the materials of the outer layer body 10, the inner layer body 20, and the adhesive strip 30 are not particularly limited to any example. The outer layer body 10, the inner layer body 20, and the adhesive strip 30 may each have a single-layer or a multi-layer structure.

The outer layer body 10 is flexible and restorable. The outer layer body 10 includes a bottom wall 11, which forms a bottom of the outer layer body 10, a side wall 12, which is coupled to an outer edge of the bottom wall 11 and which forms a trunk of the outer layer body 10, and a mouth wall 13, which is coupled to an upper portion of the side wall 12 and which has a cylindrical shape to form a mouth of the outer layer body 10. The inner layer body 20 defines, inside thereof, filling space M, which may be filled with the content medium. The inner layer body 20 may be separated from the laminated outer layer body 10 and deformed to undergo volume reduction.

Additionally, the side wall 12 in the present embodiment has a tubular shape with a circular section and with a diameter decreasing toward the mouth wall 13. However, the present disclosure is not limited to this embodiment, and the side wall 12 may have a shape with, for example, a polygonal or an elliptical section. The mouth wall 13 is provided with a screw portion 13*a*, which is used to fit a cap body or the like.

Figure 2:
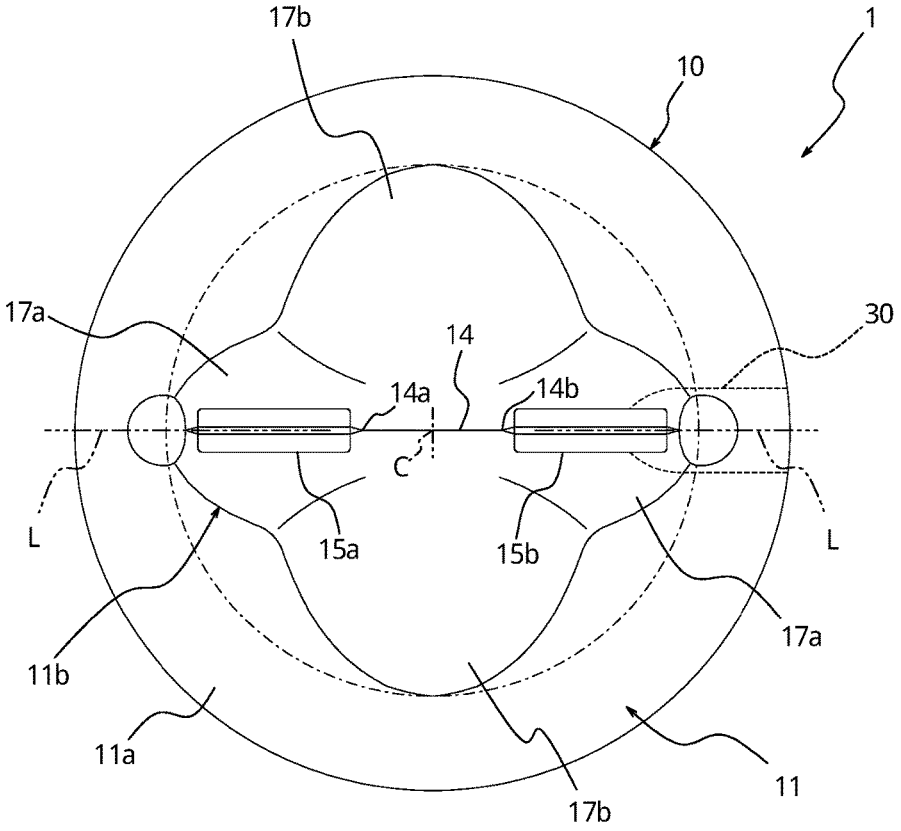
FIG. 2 is a bottom view illustrating a double-walled container of FIG. 1.

As illustrated in FIGS. 1 and 2, the bottom wall 11 includes an annular-shaped outer edge portion 11*a*, which serves as a ground-contacting surface, and a substantially cross-shaped recess 11*b*, which is located on the inner side of the outer edge portion 11*a* and which is concave toward the mouth wall 13. In a central region in the substantially cross-shaped recess 11*b*, a slit 14 is formed as an ambient air introduction hole. The slit 14 passes through the outer layer body 10 and extends linearly.

As illustrated in FIG. 2, the substantially cross-shaped recess 11*b* is configured by a first-direction recess portion 17*a*, which extends along the extending direction of the slit 14, and a second-direction recess portion 17*b*, which intersects with the first-direction recess portion 17*a*. In the present embodiment, the first-direction recess portion 17*a* and the second-direction recess portion 17*b* each have a substantially elliptical shape in a plan view thereof and also has a center positioned on the center axis C of the double-walled container 1. Furthermore, each of the first-direction recess portion 17*a* and the second-direction recess portion 17*b* has both end portions in the extending direction thereof (i.e., in a major-axis direction of the ellipse) that extend to the vicinity of the outer edge portion 11*a*. In the present embodiment, the first-direction recess portion 17*a* and the second-direction recess portion 17*b* are disposed in a manner such that the extending directions of these recess portions 17*a* and 17*b* are orthogonal to each other. Moreover, the substantially cross-shaped recess 11*b* in the present embodiment has a symmetrical shape about a straight line L, which is an extension of the slit 14.

A depth of each of the first-direction recess portion 17*a* and the second-direction recess portion 17*b* from the ground-contacting surface increases gradually from the outer side to the inner side in the radial direction and is maximum in the central region of the bottom wall 11 in which these recess portions 17*a* and 17*b* intersect with each other.

On the outer sides of both end portions 14*a* and 14*b* of the slit 14, there is also provided a pair of reinforcing ribs 15*a* and 15*b*, which extends along the extension line L of the slit 14. Herein, the slit 14 and the pair of reinforcing ribs 15*a* and 15*b* are formed in the pinched-off portion formed due to pinch-off using the splittable mold in the blow molding. That is to say, the pair of reinforcing ribs 15*a* and 15*b* is formed by squashing the outer layer body 10 and the inner layer body 20 into flat in the state where the outer layer body 10 and the inner layer body 20 are sandwiched in the splittable mold. The slit 14 is formed as follows. That is to say, the central region of the bottom of the parison is pinched off by using the splittable mold at the time of the blow molding. Then, after the blow molding, the bottom wall 11 of the outer layer body 10 is split, and the inner layer 20 is separated from the outer layer body 10. As a method of forming the slit 14 after the blow molding, the pair of reinforcing ribs 15*a* and 15*b* may be pressed toward the mouth wall 13. This method facilitates the split of the bottom wall 11 of the outer layer body 10 and the separation of the inner layer body 20 from the outer layer body 10, thus allowing the formation of the slit 14. At this time, since the reinforcing ribs 15*a* and 15*b* have higher rigidity than the portion corresponding to the slit 14, a crack in the portion of the outer layer body 10 that is to form the slit 14 does not progress beyond both the end portions 14*a* and 14*b* of the slit 14 as the bases of the reinforcing ribs 15*a* and 15*b*. Thus, the slit 14 of a desired length is formed.

Figure 3A:
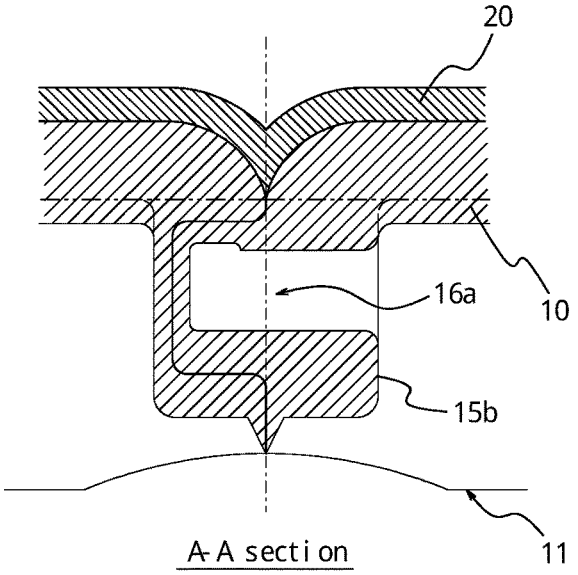
FIG. 3A is a sectional view illustrating A-A section in a double-walled container of FIG. 1.
Figure 3B:
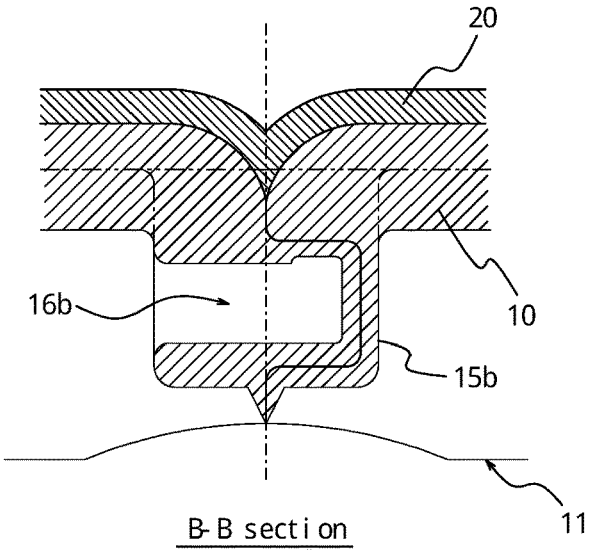
FIG. 3B is a sectional view illustrating B-B section in a double-walled container of FIG. 1.

Each of the reinforcing ribs 15*a* and 15*b* is formed with a pair of bitten portions 16*a* and 16*b*, in which the reinforcing rib is bitten from one lateral surface toward the other lateral surface thereof. Herein, FIGS. 3A and 3B are partially enlarged sectional views respectively illustrating A-A section and B-B section in the double-walled container 1 of FIG. 1. As illustrated, the bitten portion 16*a*, which is positioned on the inner side in the radial direction, and the bitten portion 16*b*, which is positioned on the outer side in the radial direction, have opposite bite directions to each other. In the present embodiment, the bitten portions 16*a* and 16*b* are provided in the pair of reinforcing ribs 15*a* and 15*b* in the configurations in which the bitten portions 16*a* and 16*b* are rotated 180 degrees about the center axis C of the double-walled container 1. Additionally, in the present embodiment, the reinforcing ribs 15*a* and 15*b* are not indispensable components. The configurations, the number, the positions, or the like of the reinforcing ribs 15*a* and 15*b*, and the configurations, the number, the positions, the bite directions, or the like of the bitten portions 16*a* and 16*b* are not particularly limited to any example.

In the present embodiment, only the single adhesive strip 30 is provided in the side wall 12. The adhesive strip 30 extends from the vicinity of one reinforcing rib 15*b* to the mouth wall 13 along the direction of the center axis C of the container 1. Additionally, an end portion of the adhesive strip 30 may be overlapped with the reinforcing rib 15*b* or may terminate before the reinforcing rib 15*b*. In the present embodiment, the adhesive strip 30 extends along the extension line L of the slit 14 and also along the parting line formed in the side wall 12 by the splittable mold. The end portion of the adhesive strip 30 that is located on the side of the bottom wall 11 is overlapped with an outer end portion of the reinforcing rib 15*b*. The length, the width, and the number of the adhesive strip 30 are not limited to any example and may be changed as appropriate. Furthermore, the adhesive strip 30 does not necessarily extend linearly and may have a bent or a curved portion. Additionally, in the present disclosure, the adhesive strip 30 is not an indispensable component. The adhesive strip 30 may be provided in only one or both of the pair of reinforcing ribs 15*a* and 15*b*.

Since the adhesive strip 30 is disposed in the vicinity of the one reinforcing rib 15*b*, the reinforcing rib 15*b* has strong adhesion. Accordingly, occurrence of a crack is further prevented in the reinforcing rib 15*b*, and even when being split, the reinforcing rib 15*b* is unlikely to be opened in response to squeezing. Additionally, the pair of bitten portions 16*a* and 16*b* is formed as follows. That is to say, pins corresponding to the bitten portions 16*a* and 16*b* are provided on surfaces of the splittable mold used in the blow molding that are to form the lateral surfaces of the reinforcing rib 15*a* and 15*b*. Then, the pins are bitten into the lateral surfaces of the reinforcing rib 15*a* and 15*b*.

To the mouth of the double-walled container 1 of the present embodiment, a dispensing cap 40 is fitted by screw engagement. The dispensing cap 40 is held in engagement with the mouth wall 13. The dispensing cap 40 includes a dispensing plug 41 and a cap body 43, which is coupled to the dispensing plug 41 via a hinge 42 for opening and closing of the dispensing plug 41. Additionally, the hinge 42 may also be omitted. In this case, the cap body 43 may be formed as a separate body that is adapted for screw engagement or undercut engagement with the dispensing plug 41.

The dispensing plug 41 includes a fitting tube 44, which is adapted for undercut engagement with an outer circumferential surface of the mouth wall 13, a partition wall 45, which covers an upper portion of the fitting tube 44, and a dispensing tube 46, which extends vertically upward from the partition wall 45 and which has an inside communicating with the filling space M. The dispensing plug 41 also includes a cylindrical wall 47, which is connected to the lower side of the dispensing tube 46. The cylindrical wall 47 is provided, on an inner circumferential surface thereof, with a plurality of longitudinal ribs 48, which is provided at an interval in the circumferential direction. On the inner side of the longitudinal ribs 48 in the radial direction, a spherical body 49 is disposed. The spherical body 49 is held by bulges provided in upper ends of the longitudinal ribs 48 in a manner such that the spherical body 49 is prevented from slipping out. The cylindrical wall 47 is provided, in a lower portion thereof, with an inclined wall 47*a*, whose diameter decreases downward. Herein, the spherical body 49 is displaceable by its own weight along the longitudinal ribs 48.

As illustrated in FIG. 1, when the double-walled container 1 is in an upright position, the spherical body 49 is in abutment against the inclined wall 47*a* over the entire circumference to seal the filling space M of the inner layer body 20.

The cap body 43 includes a top wall 50, which covers an upper side of the dispensing plug 41, and a circumferential wall 51, which is coupled to an outer edge portion of the top wall 50. The circumferential wall 51 is also coupled to the fitting tube 44 via the hinge 42. The top wall 50 is provided, in a lower surface thereof, with a sealing tube 52, which is configured to abut against the dispensing tube 46 in a liquid-tight manner. The top wall 50 is also provided, in a portion thereof that is located on the inner side of the sealing tube 52 in the radial direction, with a pin 53, which extends downward. The pin 53 is designed to abut against the spherical body 49 before the spherical body 49, when being displaced upward, reaches the upper limit. This prevents the spherical body 49 from being displaced over the bulges provided in the upper ends of the longitudinal ribs 48 and disengaged, even when the spherical body 49 is displaced upward forcibly due to transportation or the like.

To dispense the content medium from the double-walled container 1 fitted with the dispensing cap 40, the cap body 43 needs to be opened, and the double-walled container 1 needs to be brought into a tilted or an inverted position. By doing so, the spherical body 49 is displaced toward the dispensing tube 46. Accordingly, due to its own weight, the content medium in the filling space M passes from an opening defined by the inclined wall 47*a* through between adjacent longitudinal ribs 48 to be dispensed from the dispensing tube 46. At this time, ambient air is introduced between the outer layer body 10 and the inner layer body 20 through the slit 14. Accordingly, only the inner layer body 20 undergoes volume reduction while the outer layer body 10 maintains its shape.

As dispensing of the content medium progresses and the remaining amount of the content medium starts to decrease, due to the decreasing weight of the overall content medium, it becomes difficult to dispense the content medium simply by tilting the double-walled container 1. Because of this, the outer layer body 10 is to be pressed (squeezed) by holding the side wall 12 from both sides.

As described above, the slit 14 serves to introduce ambient air between the outer layer body 10 and the inner layer body 20. However, when the content medium is dispensed by utilizing squeezing, the amount of air leaking from the slit 14 is preferably minimized so that the inner layer body 20 may be pressed sufficiently.

Figure 4A:
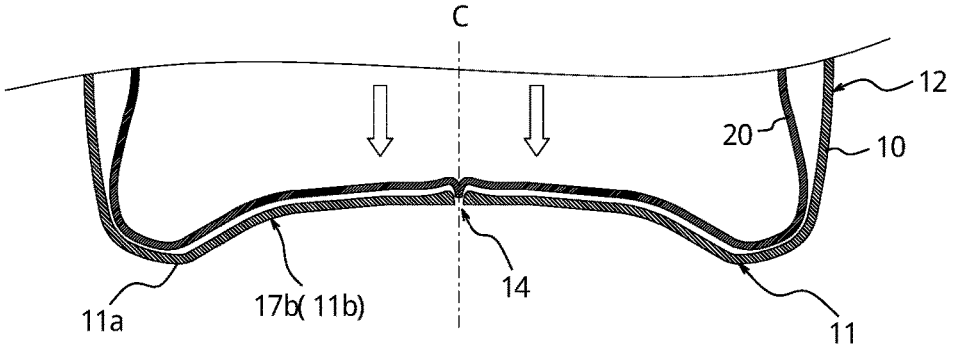
FIG. 4A is a sectional view illustrating D-D section in a double-walled container of FIG. 1.
Figure 4B:
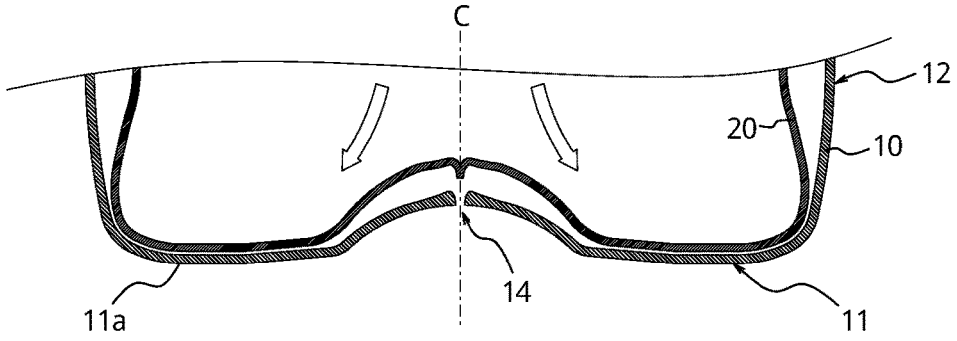
FIG. 4B is a partially enlarged sectional view illustrating a double-walled container as a reference.

Herein, FIG. 4A is a sectional view illustrating D-D section in the double-walled container of FIG. 1. FIG. 4A is a side sectional view cut by a plane passing through the center axis C along the extending direction of the second-direction recess portion 17*b*. FIG. 4B is a sectional view illustrating a double-walled container, as a reference, in which the second-direction recess portion 17*b* is not provided. In the double-walled container 1 of the present embodiment, since the substantially cross-shaped recess 11*b* is provided in the bottom, the height of the bottom wall 11 from the ground-contacting surface, especially, the height of the bottom wall 11 at both sides of the slit 14, is increased widely. As illustrated in FIG. 4B, without the substantially cross-shaped recess 11*b*, especially, without the second-direction recess portion 17*b*, being provided in the bottom, pressure of the content medium applied to the bottom of the inner layer body 20 tends to escape to the outer side in the radial direction as indicated by an arrow. Consequently, the inner layer body 20 is displaced upward and separated from the outer layer body 10 in the central region provided with the slit 14. However, in the present embodiment, as illustrated in FIG. 4A, since the height of the bottom wall 11 at both the ends of the slit 14 is increased widely, pressure of the content medium applied to the bottom of the inner layer body 20 in response to squeezing hardly escapes to the outer side in the radial direction. Consequently, the inner layer body 20, which remains adjacent to the outer layer body 10, serves to block the slit 14 in the central region provided with the slit 14. This reduces the amount of air leaking through the slit 14 from space between the outer layer body 10 and the inner layer body 20 in response to squeezing, and the inner layer body 20 is pressed sufficiently. Accordingly, the content medium, even when it is difficult to be dispensed by its own weight, may be dispensed until the double-walled container 1 is empty. Additionally, once the pressure is released, the outer layer body 10 is restored by its rigidity, and sufficient ambient air is introduced between the outer layer body 10 and the inner layer body 20 through the slit 14. Thus, the double-walled container 1 according to the present disclosure permits the content medium to be dispensed by its own weight and also permits, when the remaining amount of the content medium is decreased, the content medium to be dispensed smoothly in response to squeezing of the outer layer body 10. Furthermore, the double-walled container 1 avoids cost increase by omitting the need of the ambient air introduction valve. Additionally, with the double-walled container 1 of the present embodiment, the content medium may be dispensed in response to squeezing of the outer layer body 10 from the beginning depending on applications.

Moreover, in the present embodiment, the reinforcing ribs 15*a* and 15*b* are provided on both the sides of the slit 14. Accordingly, both the end portions 14*a* and 14*b* of the slit 14 are reinforced, and progress of a crack from both the end portions 14*a* and 14*b* of the slit 14 is prevented during molding and even during repeated use. This permits formation of the slit 14, as the ambient air introduction hole, of a predetermined length. The result is that the amount of air leaking in response to squeezing is reduced while still fully achieving the effect of the ambient air introduction hole to introduce ambient air.

Moreover, in the double-walled container 1 of the present embodiment, the bitten portions 16*a* and 16*b* are provided in each of the reinforcing ribs 15*a* and 15*b*. Accordingly, areas of compressed surfaces of the reinforcing ribs 15*a* and 15*b* are increased, and, by taking advantage of the friction, bottom crack resistance of the reinforcing ribs 15*a* and 15*b* is improved. This further ensures that progress of a crack from the slit 14 to the reinforcing ribs 15*a* and 15*b* may be prevented. Additionally, in each of the reinforcing ribs 15*a* and 15*b*, the bitten portion 16*a*, which is positioned on the inner side in the radial direction, and the bitten portion 16*b*, which is positioned on the outer side in the radial direction, are preferably configured to have opposite bite directions to each other. This further improves bottom crack resistance of the compressed surfaces in the reinforcing ribs 15*a* and 15*b*.

In the double-walled container 1 of the present embodiment, the adhesive strip 30 is provided in the vicinity of the one reinforcing rib 15*b*. Accordingly, the reinforcing rib 15*b*, near which the adhesive strip 30 is provided, has strong adhesion. This prevents occurrence and progress of a crack and enhances the effect of forming the slit 14 of a desired length.

Although the present disclosure has been described based on the illustrated examples, the present disclosure is not limited to the above embodiment and may be changed as appropriate within the scope of the claims. For example, the mouth wall 13 may be provided with an engagement projection to be plugged. In this case, the mouth wall 13 may be plugged, instead of screw-engaged, with the dispensing cap, which comes into undercut engagement.

REFERENCE SIGNS LIST

1 Double-walled container
10 Outer layer body
11 Bottom wall
11*a* Outer edge portion (ground-contacting surface)
11*b* Substantially cross-shaped recess
12 Side wall
13 Mouth wall
14 Slit
14*a*, 14*b* End portion of slit
15*a*, 15*b* Reinforcing rib
16*a*, 16*b* Bitten portion
17*a* First-direction recess portion
17*b* Second-direction recess portion
20 Inner layer body
30 Adhesive strip
40 Dispensing cap
41 Dispensing plug
42 Hinge
43 Cap body
44 Fitting tube
45 Partition wall
46 Dispensing tube
47 Cylindrical wall
47*a* Inclined wall
48 Longitudinal rib
49 Spherical body
50 Top wall
51 Circumferential wall
52 Sealing tube
53 Pin
C Center axis of container
L Extension line of slit
M Filling space

The invention claimed is:

1. A double-walled container with a bottle shape including a mouth, a trunk, and a bottom, the double-walled container comprising:

an outer layer body that constitutes an outer shell of the double-walled container;

an inner layer body that is accommodated inside the outer layer body and configured to be deformed to undergo volume reduction; and a straight slit that is provided in a pinched-off portion and that passes through the outer layer body, the pinched-off portion being formed in the bottom due to pinch-off using a splittable mold in blow molding, wherein the bottom is provided, on an inner side in a radial direction of an outer edge portion thereof serving as a ground-contacting surface, with a substantially cross-shaped recess that is concave toward the mouth, the recess is configured by a first-direction recess portion that extends along an extending direction of the slit and a second-direction recess portion that intersects with the first-direction recess portion, and the slit is provided in a region in which the first-direction recess portion and the second-direction recess portion intersect with each other, the double-walled container is configured to dispense a content medium by the weight of the content medium and also by squeezing the outer layer body, and the first-direction recess portion and the second-direction recess portion both extend to the outer edge portion.

2. The double-walled container of claim 1, wherein the first-direction recess portion and the second-direction recess portion each have a substantially elliptical shape in a plan view thereof, and each of the first-direction recess portion and the second-direction recess portion has a depth from the outer edge portion serving as the ground-contacting surface that increases gradually from an outer side to an inner side in the radial direction and that is maximum in the region in which the first-direction recess portion and the second-direction recess portion intersect with each other.

3. The double-walled container of claim 1, wherein the bottom is provided, on outer sides of both end portions of the slit provided in the pinched-off portion, with a pair of reinforcing ribs that extends along an extension line of the slit.

4. The double-walled container of claim 3, wherein each of the pair of reinforcing ribs is formed with at least one bitten portion in which the reinforcing rib is bitten from one lateral surface toward another lateral surface thereof.

5. The double-walled container of claim 4, wherein the at least one bitten portion formed in each of the pair of reinforcing ribs comprises a pair of bitten portions configured to have opposite bite directions to each other.

6. The double-walled container of claim 2, wherein the bottom is provided, on outer sides of both end portions of the slit provided in the pinched-off portion, with a pair of reinforcing ribs that extends along an extension line of the slit.

7. The double-walled container of claim 6, wherein each of the pair of reinforcing ribs is formed with at least one bitten portion in which the reinforcing rib is bitten from one lateral surface toward another lateral surface thereof.

8. The double-walled container of claim 7, wherein the at least one bitten portion formed in each of the pair of reinforcing ribs comprises a pair of bitten portions configured to have opposite bite directions to each other.

* * * * *